US005515797A

United States Patent [19]

Janouschek et al.

[11] Patent Number: 5,515,797

[45] Date of Patent: May 14, 1996

[54] PRESSER FOOT WITH SWINGING PRESSER FOOT SOLE FOR A SEWING MACHINE

[75] Inventors: Heinz Janouschek, Steckborn, Switzerland; Lorenz Reber, Gaienhofen, Germany

[73] Assignee: Fritz Gegauf Aktiengesellschaft, Steckborn, Switzerland

[21] Appl. No.: 213,841

[22] Filed: Mar. 14, 1994

[30] Foreign Application Priority Data

Mar. 31, 1993 [CH] Switzerland ..... 00 983/93

[51] Int. Cl.[6] ..... D05B 29/08

[52] U.S. Cl. ..... 112/235

[58] Field of Search ..... 112/60, 235, 236, 112/240, 308, 309, 324, 322

[56] References Cited

U.S. PATENT DOCUMENTS

| | | | |
|---|---|---|---|
| 751,057 | 2/1904 | Cooper et al. | 112/235 |
| 913,847 | 3/1909 | Prall | 112/236 |
| 1,930,628 | 10/1933 | Smallbone | 112/240 |
| 2,808,794 | 10/1957 | Ayres | 112/235 |
| 2,878,765 | 3/1959 | Gegauf | 112/240 |
| 4,187,794 | 2/1980 | Ross et al. | 112/308 |

*Primary Examiner*—Ismael Izaguirre
*Attorney, Agent, or Firm*—Edwin D. Schindler

[57] ABSTRACT

A presser foot for a sewing machine includes a presser foot with a shank. The end of the presser-foot shank is articulated with a presser-foot sole having a stitching opening for a needle, which is attached to a needle bar. The presser-foot sole is capable of being swung relative to an upper-part of a housing therefor about the axis of the needle. In a preferred embodiment, the presser foot of the invention, which is connected to the sewing machine in a manner so that it is capable of being swung at least 180°, makes it possible for the operator of the sewing machine to adjust the presser foot and/or the presser-foot sole so as to make it essentially parallel to the sewing direction and, in this fashion, to allow the sewing-over of thickenings, hemmed borders and the like.

29 Claims, 3 Drawing Sheets

PRESSER FOOT WITH SWINGING PRESSER FOOT SOLE FOR A SEWING MACHINE

BACKGROUND OF THE INVENTION

1. Technical Field of the Invention

The present invention relates to a presser foot for a sewing machine. More particularly, the present invention provides a presser foot which makes it possible to apply seams, not only in parallel to the common, or conventional, sewing direction, but also to apply seams which lie, star-fashion, within a range of 360° with respect to the axis of the sewing needle.

2. Description of the Prior Art

The electronic controls which are built into present-day sewing machines make it possible to move the fabric being worked on, which lies between the fabric support and the presser foot, in any desired direction, even directions that lie crosswise to the forward and backward movement of the fabric feeder. In other words, the fabric-feeding motion encompasses a range of 360°.

When working outside of the normal conveying direction, a problem is encountered with conventional devices in that the presser foot, which is connected to the presser bar of the sewing machine, does not face into the corresponding sewing direction. The presser foot is attached to the sewing machine in a manner such that its alignment corresponds to the generally accepted sewing direction. Consequently, the highly bent sole parts, which form inlet radii and which facilitate the in-feed of the material to be sewn, underneath the support surface of the sole, are only fully effective in this one direction. If sewing is carried out at an angle to the common sewing direction, or even crosswise to the latter, the highly bent sole parts can fulfill their natural function only in part, or sometimes, not at all. The material to be sewed then accumulates laterally at one of the edges of the presser-foot sole, and—depending on the sewing direction—is more or less drawn and distorted; a problem which particularly affects elastic sewing materials. This produces an unattractive or even unusable sewing result. In so doing, seams, thickenings, hemmed borders and similar details already present in the material to be sewn are deleteriously affected and can become entangled at the sole of the presser foot.

U.S. Pat. No. 1,930,628, discloses a presser foot for a sewing machine, the sole of which can be inclined with reference to the horizontally lying support. For that purpose, a fastening screw at the presser foot must be loosened and the foot moved into the appropriate position. In the position as adjusted, the presser foot of the prior art must again be fastened and then maintains its position. This known presser foot is suitable for the sewing of straw hats, which are sewn together out of ribbons that overlap at the edges so that, during sewing, one-half of the presser foot always lies lower than the other half. Consequently, the presser foot must be placed in the angled position only once, after which the entire hat can be sewn in the adjusted position. The sewing direction always runs parallel to the lateral edges of the presser foot.

SUMMARY OF THE INVENTION

It is, therefore, an object of the present invention is to provide a presser foot for a sewing machine which makes it possible to apply seams, not only in parallel to the common sewing direction, but also seems which lie, star-fashion, within a range of 360° with respect to the axis of the sewing needle.

The foregoing and related objects are achieved by the present invention in which a presser foot for a sewing machine is claimed having a presser foot with a shank. The end of the presser-foot shank is articulated with a presser-foot sole having a stitching opening for a needle, which is attached to a needle bar. The presser-foot sole is provided with means for allowing it to be swung relative to an upper-part of a housing therefor about the axis of the needle, which allows the needle to be driven so as to move upwards and downwards in its mid-position.

In a preferred embodiment, the presser foot of the invention, which is connected to the sewing machine in a manner so that it is capable of being swung at least 180°, makes it possible for the operator of the sewing machine to adjust the presser foot and/or the presser-foot sole so as to make it essentially parallel to the sewing direction and, in this fashion, to allow the sewing-over of thickenings, hemmed borders and the like. The presser-foot sole can be manually turned by overcoming a spring action and can be rotated with respect to the presser-foot shank; it automatically clicks into pre-determined angular positions with respect to the normal sewing direction. The presser-foot sole is connected with the lower end of the presser-foot shank in a manner such that it is also capable of being swung, to a limited degree, horizontally, lengthwise and crosswise to the sewing direction in order to permit the over-sewing and cross-sewing of thickenings in the material to be sewn, without problems.

In a further preferred embodiment of the present invention, the presser-foot shank, with the presser-foot sole attached thereto, can be rotated in a guide shaped as a circular arc and can, thus, be adjusted in accordance with the desired direction of sewing. By means of a drive, the adjustment of the sewing direction of the presser foot can be carried out in accordance of with a pre-set program (e.g., a computer program) via the electronics of the machine.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
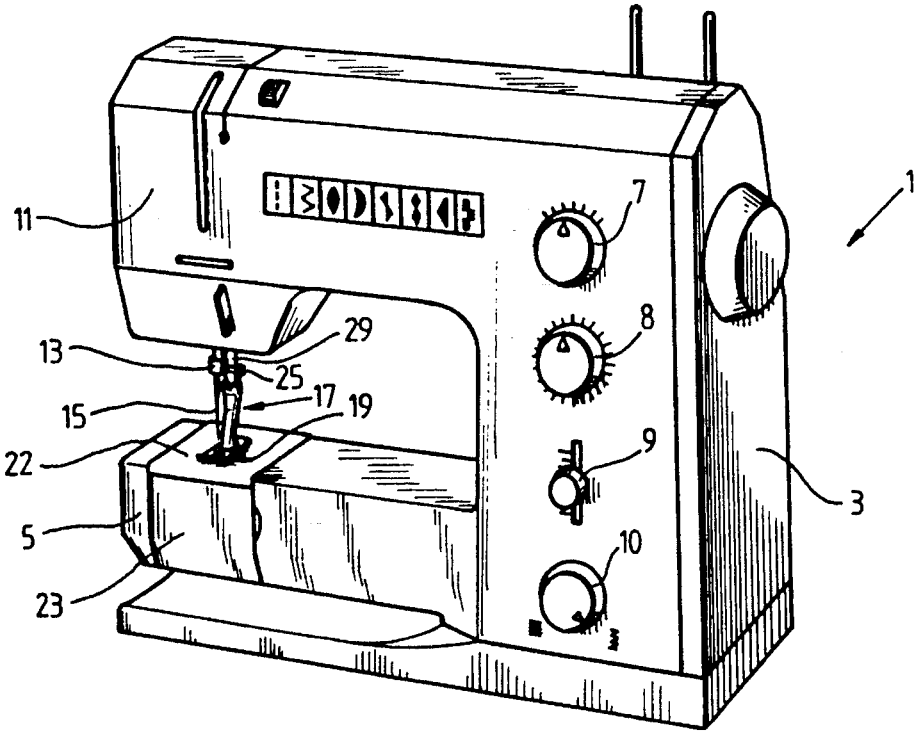
FIG. 1 is a perspective view of a sewing machine.
Figure 2:
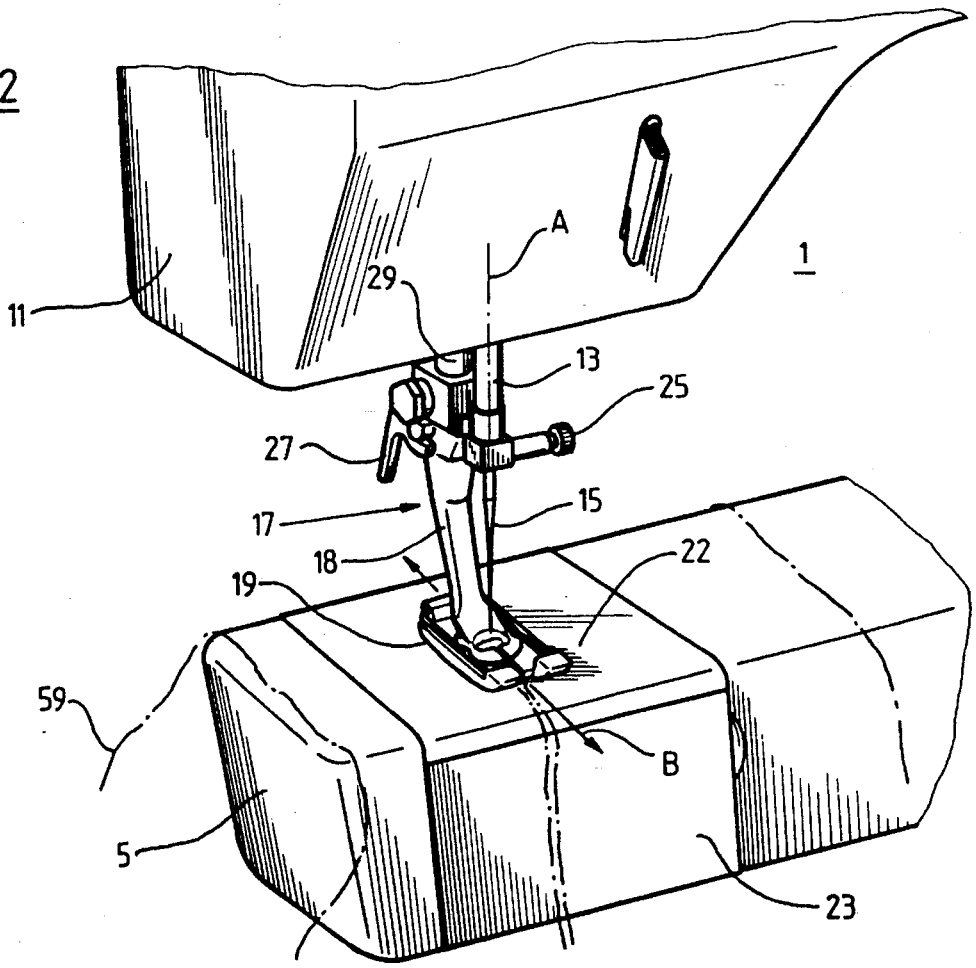
FIG. 2 is an enlarged perspective view of a cutout of the sewing machine of FIG. 1, showing the sewing area thereof.
Figure 3:
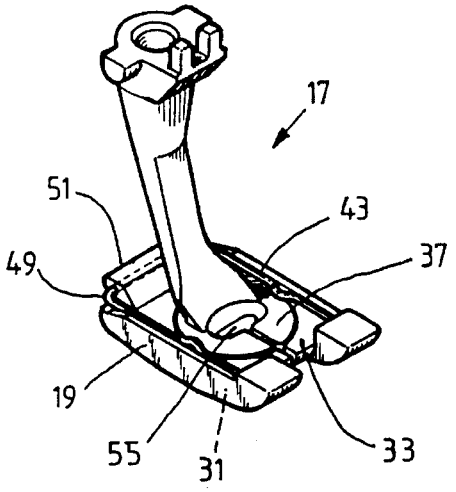
FIG. 3 is an enlarged perspective view of the presser-foot shank of the present invention.

Turning now, in detail, to an analysis of the accompanying drawing figures, a sewing machine 1 is illustrated in FIG. 1 which features a housing 3, the lower part of which is constructed as a free arm 5. On the front side of the housing 3, the operating elements, such as the rotating or sliding buttons 7, 8, 9 and 10, are shown schematically. On the underside of the upper part of the housing 11, there protrudes a needle bar 13 with the needle 15, the presser foot 17 with its presser-foot shank 18 and with the presser-foot sole 19, arranged at its lower end. Not visible in FIG. 1 (see, FIG. 7) is a fabric feeder 21, also called a feeder or transporter in the art, which lies underneath a needle plate 22 and which is completely covered by the presser-foot sole 19. Also not readily visible and covered by a lid 23 on the free arm 5 is a shuttle mechanism and a drive for the fabric feeder device 21. A possible design of a fabric feeder device is described in U.S. Pat. No. 4,187,794, with the disclosed fabric feeder device of the foregoing United States patent being incorporated into this disclosure by reference.

The needle 15 is fastened in a conventional manner to the needle bar 13 by means of a needle holding screw 25. The presser foot 17, in turn, is connected to the lower end of the presser bar 29 by means of a retention lever 27 of conventional construction. The presser bar 29 can be raised or lowered in a conventional manner by an operator of the sewing machine by means of a lever.

In a first preferred embodiment of the invention, as illustrated in FIGS. 1–5, the presser-foot sole 19 features an essentially rectangular design; its sole 31 is curved or bent upwards at both ends in order to ensure a problem-free gliding of the presser-foot sole 19, even over seams and thickenings. Crosswise to the normal sewing direction B, the presser-foot sole 19 is designed in an essentially flat fashion in order to ensure a good support upon the fabric feeder 21.

A recess 35, shaped in concave or conical fashion and featuring a circular cross-section, is embedded into the upper side 33 of the presser-foot sole 19, into which recess engages the lower, dish-shaped end 37 of the presser-foot shank 18. The jaws 38, which project downwards from the dish-shaped end 37, engage into a circular breach 40 of the presser-foot sole 19, and together make up the centering means between the shank 18 and the sole 19. At the same time, the jaws 38 flank a stitching hole 55, which is arranged in the dish-shaped end 37. The circular-ring-shaped margin 42, which envelopes the jaws 38, is equipped with a "click-in" toothing 41; the latter runs in a radial direction and works in conjunction with a dual-ramp-shaped or rib-shaped retention cam 39, which is arranged in the recess 35 in order to retain the presser-foot sole 19, either in an angular position with respect to the normal sewing direction B, in which it was adjusted, or in the normal position itself. The knife-edge-shaped retention cam 39, furthermore, makes it possible to rock the presser-foot sole 19 around a horizontal axis C.

The connection between the lower end 37 of the presser-foot shank 18 and the presser-foot sole 19 is provided by a spring 43, designed in a U-shaped manner, whose leg tips 45 protrude into recesses 47 of the presser-foot sole 19 and whose base leg 49 is supported on an overhanging tab 51. The two legs of the spring 43 are angled in a V-shape or are bent so that the lower end 37, with its "click-in" toothing 41, abut in a spring-action fashion against the retention cam 39 in the recess 35. By overcoming the spring action, the presser-foot sole 19, at the lower end 37, can be rotated around the axis A, and clicked in.

The presser-foot sole 19 and the dish-shaped end 37, furthermore, feature a threading slit 53, which ends in the stitching hole 55. The stitching hole 55 is designed in slit-shaped form, and lies at right angles to the threading slit 53, in order to permit the production of zig-zag seams by means of a lateral shift of the needle 15 with respect to the normal stitching axis A.

When sewing a normal seam in order to link two pieces of sewing material 59, the movement occurs in the normal sewing direction B, either forwards or backwards. With a fabric feeder 21 of conventional construction, the sewing material is thereby conveyed by an oscillating movement of the fabric feeder 21 in parallel with the feed axis B.

By overlaying a movement of the fabric feeder 21, i.e., crosswise to the normal sewing direction B, the sewing material 59 may be conveyed at any desired angle D with respect to the normal sewing direction B. The mechanical design of the drive of a fabric feeder 21, on which a lateral movement is overlaid, is not an object of the present invention. One possible design of the drive of the fabric feeder 21 may be found, for example, in U.S. Pat. No. 4,187,794, the disclosure of which is incorporated by reference herein. In U.S. Pat. No. 4,187,794, the normal feed movement of fabric feeder 21 is overlaid by a shifting of the fabric feeder 21, which occurs at right angles to the normal direction B.

Figure 8:
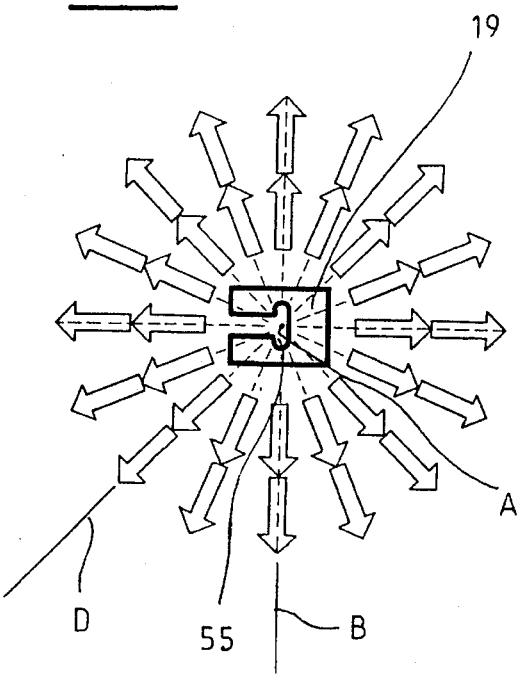
Figure 4:
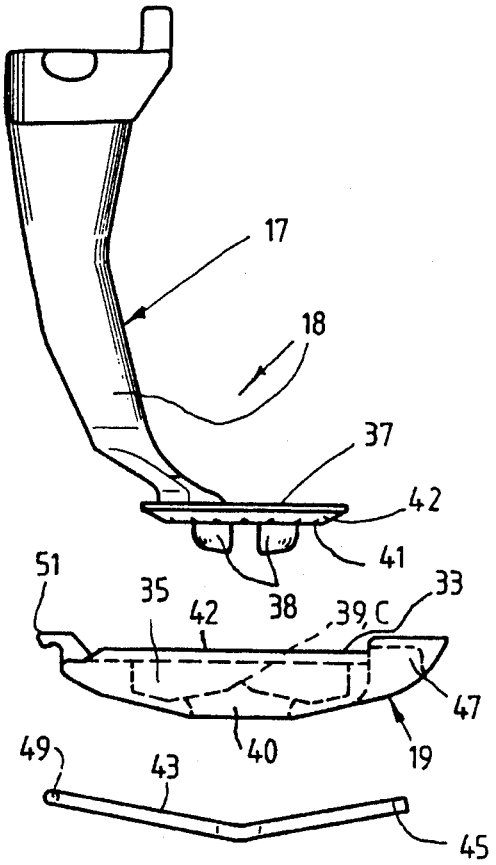
FIG. 4 is an exploded, elevational view of the presser-foot shank of FIG. 3 showing its individual parts.
Figure 5:
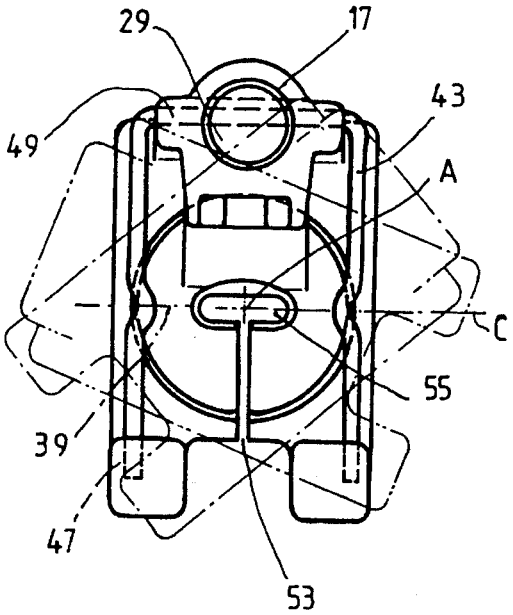
FIG. 5 is a top view of the presser-foot shank of FIG. 3, shown in a plurality of swung positions.
Figure 6:
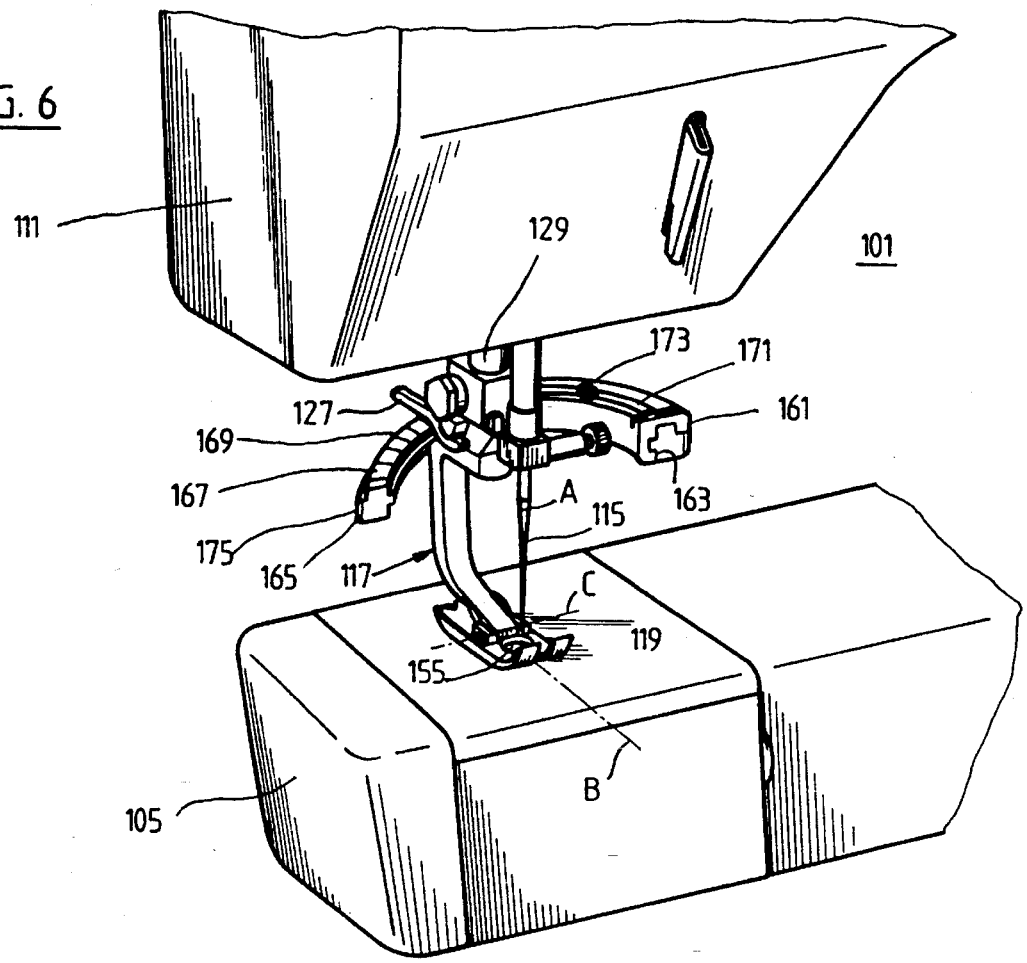
FIG. 6 is an enlarged perspective view of a cutout of the sewing machine, in the area of the presser foot, illustrating a further embodiment of the present invention.
Figure 7:
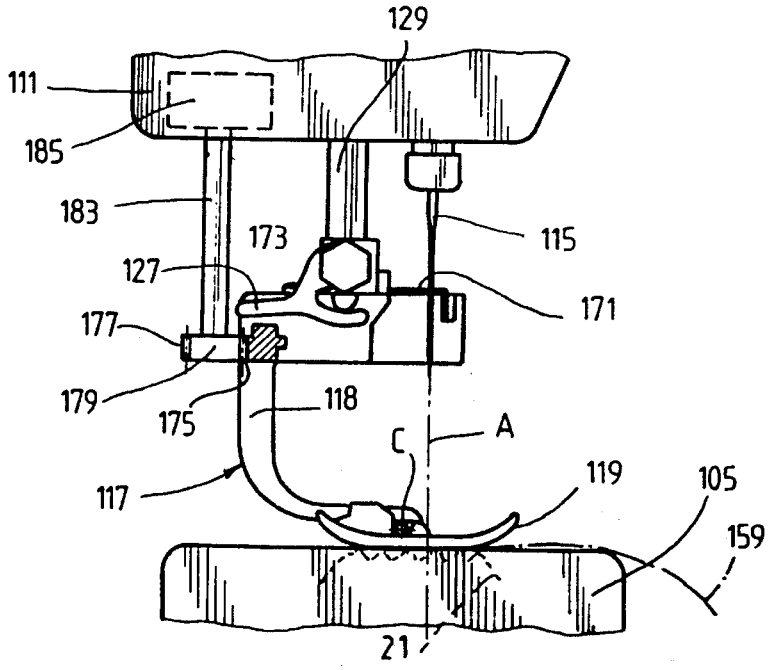
FIG. 7 is an enlarged elevational view of a cutout of the sewing machine, in the area of the presser-foot shank, according to the embodiment of FIG. 6; and, FIG. 8 is a schematic representation of the possible sewing direction achievable with the present invention.

In so doing, the control of the motion of the fabric feeder 21 may be effected with the aid of an electronic program control, wherein the desired direction of sewing is adjusted either as a function of a program or, for example, by means of an operating button 8, In the embodiment of the invention as illustrated in FIGS. 6–8, the presser-foot sole 19, which is capable of being rotated around the axis A at the lower end 37 of the presser-foot shank 18, is replaced by a presser foot 117, which is capable of being swung around the same axis. At the lower end of the presser bar 129—which carries the presser-foot shank 118 and which projects from the upper part 111 of the housing of the sewing machine 101, lying opposite the free arm 105—a circular-arc-shaped guide segment 161 is fastened in a known manner, like a conventional presser foot, with a guide slot 163 cut into it. The guide segment 161 is fastened with a retention lever 127 at the lower end of the fabric-feeder bar 129. In the illustrated design of the guide segment 161, the latter features an arc length of about 90°. In this quadrant-shaped guide segment 161, a semi-circular presser-foot carrier 165 is guided. The cross-section of the presser-foot carrier 165 is designed in a manner such that it is held and guided in the guide slot 163 in the guide segment 161, in an essentially clearance-free manner. In the cover surface 167 of the presser-foot carrier 165, which cover surface lies above and is shaped as a circular ring, there are embedded "click-in" grooves 169 that run radially, in which grooves there click in the offset end of a "click-in" spring 171. The spring 171 is attached to the guide segment 161 and is pre-tensioned with a screw 173; the spring can prevent the presser-foot carrier 165 from rotating. As an alternative to the radially-running grooves 169, it is, of course, possible to provide other "click-in" means. The "click-in" spring 171 is designed to maintain, during sewing, the presser-foot carrier 165 in a predetermined position with respect to the guide segment 161.

The presser-foot shank 118 is fastened on the underside of the presser-foot carrier 165. Preferably, the presser-foot carrier 165 and the presser-foot shank 118 of the fabric-feeder foot 117 make up a single piece, either cast or injected. At the lower end of the presser-foot shank 118, a presser-foot sole 119 is fastened in a manner articulated around a horizontal axis C, in a conventional manner, e.g., as disclosed in U.S. Pat. No. 4,643,116, the pertinent disclosure of which is hereby incorporated herein by reference. In the basic position of the presser-foot shank 118, the horizontal swivel-axis C lies at right angles to the normal sewing direction B.

The grooves in the cover surface 167 of the presser-foot carrier 165 are designed in a manner such that the presser foot 117 can only be swung into the guide slot 163 of the guide segment 161 by overcoming a resistance. In the illustrated embodiment of the invention, the presser foot 117 may be swung for a total of 180°, as illustrated in FIG. 8. In this fashion, sewing in all directions is possible.

Inasmuch as in this design, not only the presser-foot sole 119, but the entire presser foot 117 is rotated around axis A, the stitching hole 155 is designed to be circular so that the needle 115 can be swung outwardly over the entire zigzag width, in any position of the presser foot 117.

It is possible to attach a toothing 175 at the periphery of the presser-foot carrier 165, in which toothing engages the teeth 177 of the toothed pinion 179. The toothed pinion sits at the end of a driven shaft 183 of a drive motor, such as a stepping motor 185. The stepping motor 185 can be housed in the upper part of housing 111.

In order to sew a seam in, for example, direction D, which seam runs about 45° to the main sewing direction B (see, e.g., FIG. 8), in the first preferred embodiment of the invention described, it is the presser-foot sole 19 that is swung by 45°, while in the second preferred embodiment described, it is the presser-foot carrier 165 with the presser-foot shank 118 and the presser-foot sole 119, attached to the presser-foot carrier 165, that are so swung. If a stepping motor 185 is available, the swinging motion may be carried out, while being controlled by a program, by the stepping motor via the toothed pinion 179 and the toothing 175. After the movement of rotation has been concluded, the presser-foot sole 19, 119 lies in the new sewing direction D, and is capable of gliding over fabric thickenings or seams, in a known manner, without permitting the occurrence of any accumulations of the material to be sewn 59, 159, at the edge of the presser-foot sole 19, 119.

Inasmuch as the movement of rotation of the presser-foot sole 19, 119 always occurs precisely around the axis A of the needle 15, 115, the situation in the area of the stitching hole 55, 155 does not change, and seams in all sewing directions can be produced.

While only several embodiments of the present invention have been shown and described, it will be obvious to those skilled in the art that many modifications may be made to the present invention without departing from the spirit and scope thereof.

What is claimed is:

1. A sewing machine, comprising:

a housing;

a needle bar;

a sewing needle attached to said needle bar;

a presser foot with a presser-foot shank;

a presser-foot sole at an end of said presser-foot shank, said presser-foot sole having a stitching opening for said sewing needle, said presser-foot sole including means for fixing said presser-foot sole into a normal sewing direction and into a plurality of intermediate positions between the normal sewing direction and an angle of at least 90° from the normal sewing position, said normal sewing direction being the sewing direction directly away from, and directly towards, a user of said sewing machine; and, means for swinging said presser-foot sole, relative to an upper part of said housing, around an axis of said needle in which said needle is driven upward and downward at a mid-position of a sewing line defined by said needle and said needle bar.

2. The sewing machine according to claim 1, wherein said presser-foot sole is articulated at a lower end of said presser-foot shank so that said presser-foot sole is capable of being swung around the axis of said needle in said mid-position.

3. The sewing machine according to claim 2, wherein said presser-foot sole includes a circular recess and the lower end of said presser-foot shank is constructed in a dish-shaped form for engaging into said recess at said presser-foot sole for producing a connection capable of rotation of said presser foot and said presser-foot sole.

4. The sewing machine according to claim 3, further comprising means for retaining said presser-foot sole relative to the lower end of said presser-foot shank in a plurality of angular positions and for fixing said presser-foot sole in an articulated manner around a horizontal axis.

5. The sewing machine according to claim 4, wherein said presser-foot sole is connected with a spring to the lower end of said presser-foot shank, with said spring acting to maintain said means for retaining in an engaged position in a detachable manner.

6. The sewing machine according to claim 4, wherein said means for retaining are lock-in means.

7. The sewing machine according to claim 1, wherein said presser foot is connected with said presser-foot shank and in which said presser-foot sole and said presser-foot shank include means for swinging said presser foot around the axis of said needle in said mid-position.

8. The sewing machine according to claim 7, further comprising a presser-foot carrier and a presser bar, wherein said presser-foot shank is attached to said presser-foot carrier and said presser-foot shank is guided with said presser-foot carrier in a circular-arc-shaped guide segment at a lower end of said presser bar, said presser bar carrying said presser-foot shank.

9. The sewing machine according to claim 8, wherein said presser-foot carrier is guided in a guide slot in said circular-arc-shaped guide segment.

10. The sewing machine according to claim 9, further comprising lock-in means, wherein said presser-foot carrier, when in an adjustable position, is capable of being retained in a fixed manner by said lock-in means.

11. The sewing machine according to claim 10, wherein said lock-in means is a spring and is attached to said circular-arc-shaped guide segment for clicking into a groove on a cover surface of a sewing carrier.

12. The sewing machine according to claim 8, further comprising motorized means, wherein said presser-foot carrier is connected by toothing means with said motorized means and is swingable by swing means of said motorized means about the axis of said needle in said mid-position.

13. A sewing machine, comprising:

a housing;

a needle bar;

a sewing needle attached to said needle bar;

a presser foot with a presser-foot shank;

a presser-foot sole at an end of said presser-foot shank, said presser-foot sole having a stitching opening for said sewing needle, said presser-foot sole being articulated at a lower end of said presser-foot shank so that said presser-foot sole is capable of being swung around the axis of said needle in said mid-position; and, means for swinging said presser-foot sole, relative to an upper part of said housing, around an axis of said needle in which said needle is driven upward and downward at a mid-position of a sewing line defined by said needle and said needle bar.

14. The sewing machine according to claim 13, wherein said presser-foot sole includes means for fixing said presser-foot sole into a normal sewing direction and into a plurality of intermediate positions between the normal sewing direction and an angle of at least 90° from the normal sewing position, said normal sewing direction being the sewing direction directly away from, and directly towards, a user of said sewing machine.

15. The sewing machine according to claim 14, wherein said presser-foot sole includes a circular recess and the lower end of said presser-foot shank is constructed in a dish-shaped form for engaging into said recess at said presser-foot sole for producing a connection capable of rotation of said presser foot and said presser-foot sole.

16. The sewing machine according to claim 15, further comprising means for retaining said presser-foot sole relative to the lower end of said presser-foot shank in a plurality of angular positions and for fixing said presser-foot sole in an articulated manner around a horizontal axis.

17. The sewing machine according to claim 16, wherein said presser-foot sole is connected with a spring to the lower end of said presser-foot shank, with said spring acting to maintain said means for retaining in an engaged position in a detachable manner.

18. The sewing machine according to claim 16, wherein said means for retaining are lock-in means.

19. The sewing machine according to claim 13, wherein said presser foot is connected with said presser-foot shank and in which said presser-foot sole and said presser-foot shank include means for swinging said presser foot around the axis of said needle in said mid-position.

20. The sewing machine according to claim 19, further comprising a presser-foot carrier and a presser bar, wherein said presser-foot shank is attached to said presser-foot carrier and said presser-foot shank is guided with said presser-foot carrier in a circular-arc-shaped guide segment at a lower end of said presser bar, said presser bar carrying said presser-foot shank.

21. The sewing machine according to claim 20, wherein said presser-foot carrier is guided in a guide slot in said circular-arc-shaped guide segment.

22. The sewing machine according to claim 21, further comprising lock-in means, wherein said presser-foot carrier, when in an adjustable position, is capable of being retained in a fixed manner by said lock-in means.

23. The sewing machine according to claim 22, wherein said lock-in means is a spring and is attached to said circular-arc-shaped guide segment for clicking into a groove on a cover surface of a sewing carrier.

24. The sewing machine according to claim 20, further comprising motorized means, wherein said presser-foot carrier is connected by toothing means with said motorized means and is swingable by swing means of said motorized means about the axis of said needle in said mid-position.

25. A sewing machine, comprising:

a housing;

a needle bar;

a sewing needle attached to said needle bar;

a presser foot with a presser-foot shank;

a presser-foot sole at an end of said presser-foot shank, said presser-foot sole having a stitching opening for said sewing needle, said presser foot being connected with said presser-foot shank, wherein said presser-foot sole and said presser-foot shank include means for swinging said presser foot around the axis of said needle in said mid-position;

means for swinging said presser-foot sole, relative to an upper part of said housing, around an axis of said needle in which said needle is driven upward and downward at a mid-position of a sewing line defined by said needle and said needle bar; and, a presser-foot carrier and a presser bar, said presser-foot shank being attached to said presser-foot carrier and said presser-foot shank being guided with said presser-foot carrier in a circular-arc-shaped guide segment at a lower end of said presser bar, said presser bar carrying said presser-foot shank.

26. The sewing machine according to claim 25, wherein said presser-foot carrier is guided in a guide slot in said circular-arc-shaped guide segment.

27. The sewing machine according to claim 26, further comprising lock-in means, wherein said presser-foot carrier, when in an adjustable position, is capable of being retained in a fixed manner by said lock-in means.

28. The sewing machine according to claim 27, wherein said lock-in means is a spring and is attached to said circular-arc-shaped guide segment for clicking into a groove on a cover surface of a sewing carrier.

29. The sewing machine according to claim 25, further comprising motorized means, wherein said presser-foot carrier is connected by toothing means with said motorized means and is swingable by swing means of said motorized means about the axis of said needle in said mid-position.

* * * * *